US005301834A

United States Patent [19]

Lee et al.

[11] Patent Number: 5,301,834

[45] Date of Patent: Apr. 12, 1994

[54] CARD VENDING MACHINE

[75] Inventors: Carroll J. Lee; Kenneth A. Lee, both of Columbus; Robert J. Palmquist, Omaha, all of Nebr.

[73] Assignee: The Lift Ticket, Oakland, Iowa

[21] Appl. No.: 6,503

[22] Filed: Jan. 21, 1993

[51] Int. Cl.[5] ..... B65H 3/44; G07F 11/00

[52] U.S. Cl. ..... 221/129; 221/131; 221/197; 221/277; 221/241; 221/2; 271/118; 271/124; 271/165

[58] Field of Search ..... 221/129, 131, 197, 198, 221/241, 277, 287, 2; 271/117, 118, 124, 125, 165

[56] References Cited

U.S. PATENT DOCUMENTS

| | | | |
|---|---|---|---|
| 2,481,934 | 9/1949 | Langston | 164/68 |
| 3,367,467 | 2/1968 | Ptacek | 194/4 |
| 3,397,763 | 8/1968 | Wahlberg | 194/4 |
| 3,493,771 | 2/1970 | Beltz et al. | 250/219 |
| 3,514,098 | 5/1970 | Ostwald | 271/41 |
| 3,770,089 | 11/1973 | Verduin et al. | 194/1 N |
| 3,791,269 | 2/1974 | Sawada | 93/93 DP |
| 3,874,652 | 4/1975 | Bilbrey | 271/35 |
| 3,933,350 | 1/1976 | Mignano | 271/165 |
| 4,053,152 | 10/1977 | Matsumoto | 271/9 |
| 4,312,503 | 1/1982 | Saxinger et al. | 271/34 |
| 4,508,332 | 4/1985 | Nishio | 271/118 |
| 4,526,264 | 7/1985 | MacNamara et al. | 194/1 N |
| 4,572,498 | 2/1986 | Shiozawa | 271/34 |
| 4,591,069 | 5/1986 | Stewart | 221/129 |
| 4,634,111 | 1/1987 | Frank | 271/34 |
| 4,643,412 | 2/1987 | Heina et al. | 271/94 |
| 4,674,618 | 6/1987 | Eglise et al. | 194/210 |
| 4,723,773 | 2/1988 | Westover et al. | 271/10 |
| 4,847,473 | 7/1989 | Lee et al. | 235/381 |
| 4,866,259 | 9/1989 | Bonnemoy | 235/475 |
| 4,869,395 | 9/1989 | Rubbmark | 221/287 |
| 4,925,062 | 5/1990 | Tsukamoto et al. | 271/115 |
| 4,934,686 | 6/1990 | Ono et al. | 271/118 |
| 5,100,022 | 3/1992 | Fukudome et al. | 221/198 |

FOREIGN PATENT DOCUMENTS

| | | | |
|---|---|---|---|
| 60-40193 | 2/1985 | Japan | 235/475 |
| 0012592 | 1/1990 | Japan | 221/198 |

OTHER PUBLICATIONS

Brochure "The Club Man", 1987.

*Primary Examiner*—H. Grant Skaggs
*Attorney, Agent, or Firm*—Zarley, McKee, Thomte, Voorhees & Sease

[57] ABSTRACT

A card vending machine comprising a cabinet having a plurality of card holding and dispensing modules individually removably positioned therein with each of the modules including a card holding portion and card dispensing portion. Each of the modules includes a gauge cam to enable the card dispensing portions of the modules to be adjusted to compensate for cards having various thicknesses.

8 Claims, 6 Drawing Sheets

CARD VENDING MACHINE

BACKGROUND OF THE INVENTION

This invention relates to a card vending machine and more particularly to a machine which may dispense pull tab cards, breakopens, (pickle cards) or lottery tickets.

Pull tab cards, breakopens or pickle cards have become extremely popular the last few years. The pull tabs are normally dispensed by an attendant, waitress, bartender, etc. and are usually pulled from a stack of the pull tabs. The primary problem associated with the commonly employed method of dispensing the pull tabs is that it is difficult to control the money being handled by the dispensing person.

In an effort to avoid the necessity of the need for manually dispensing the pull tabs, some card dispensing machines have been previously provided but they do have several shortcomings. One shortcoming of the prior art machines is that they are unable to dispense various priced pull tabs. Further, a disadvantage of the prior art machines is that the dispensing means within the dispenser is less than reliable. To overcome the problems associated with the prior art machines, two of the named applicants herein previously devised a card vending machine and received U.S. Pat. No. 4,847,473 for their improved card vending machine. Although the card vending machine of U.S. Pat. No. 4,847,473 has met with considerable success, it has been found that it is desirable to be able to replace entire card holding and dispensing modules in the machine for ease of maintenance. Further, it has been found that the thickness of the cards may vary which can cause dispensing problems. This is especially true if the machine is going to handle not only pull tabs but may also handle lottery cards or tickets.

Therefore, it is the principal object of the invention to provide an improved card dispensing machine.

A further object of the invention is to provide an improved card dispensing machine including a plurality of individual card holding and dispensing modules which may be individually replaced thereby enhancing the maintenance of the machine.

Still another object of the invention is to provide an improved card dispensing machine having means thereon to adjust the dispensing mechanism to compensate for cards having various thicknesses.

Still another object of the invention is to provide an improved card or ticket dispensing machine which is economical of manufacture, durable in use and refined in appearance.

These and other objects will be apparent to those skilled in the art.

SUMMARY OF THE INVENTION

Figure 2:
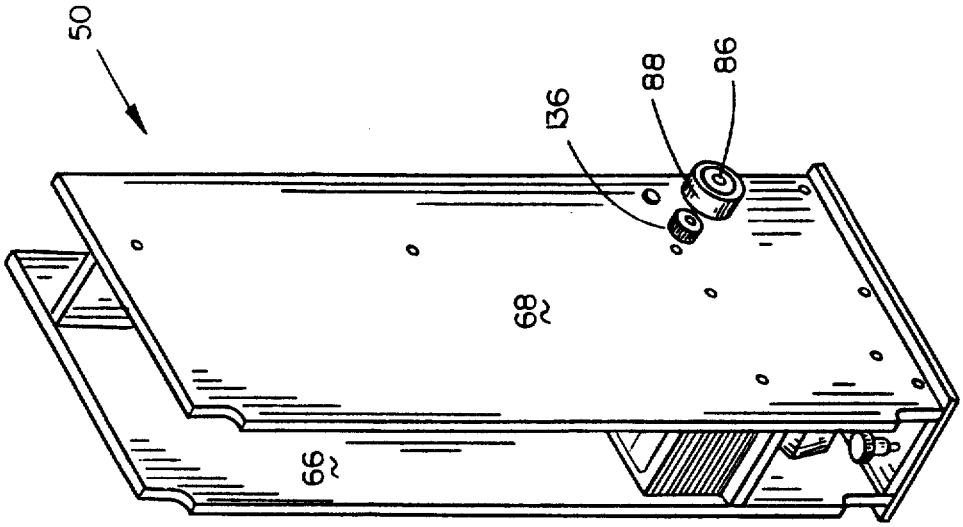
FIG. 2 is a front perspective view of one of the card holding and dispensing modules.
Figure 1:
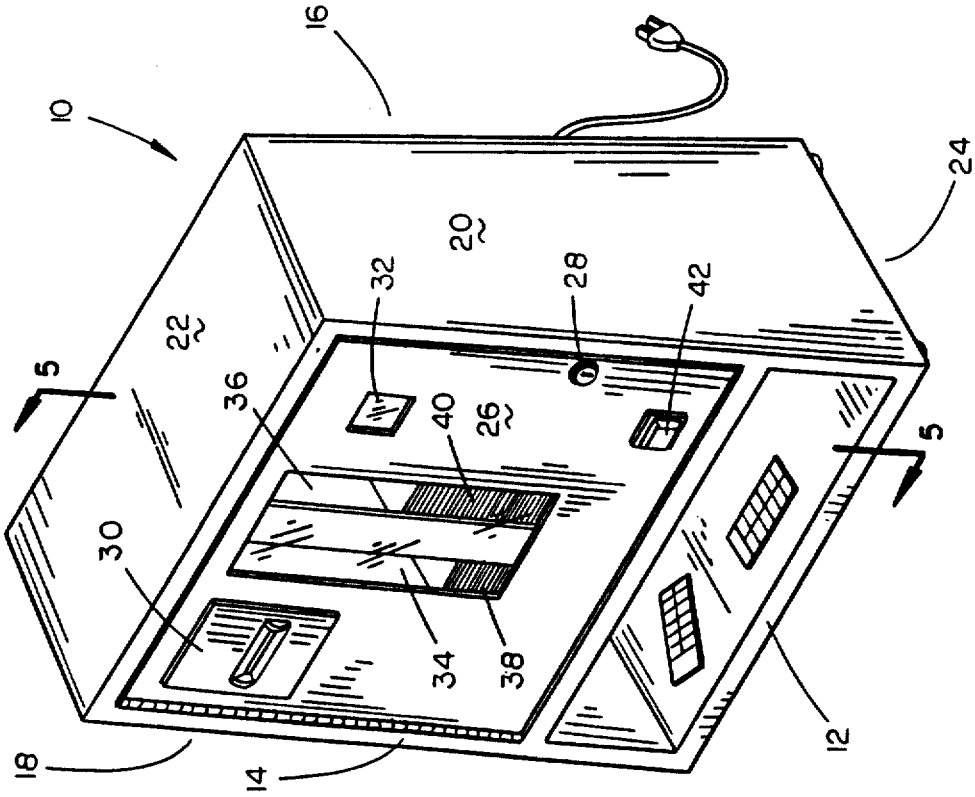
FIG. 1 is a front perspective view of the machine of this invention.

A card vending machine is described which includes a cabinet having a plurality of card holding and dispensing modules positioned therein. Each of the card holding and dispensing modules is individually removably positioned in the cabinet so that the module may be easily replaced if necessary. Each of the modules includes a card holding portion for holding a plurality of cards therein in a stacked condition. Each of the modules also includes a card dispensing mechanism which dispenses the lowermost card in the stack in the associated card holding portion. Each of the card dispensing mechanisms is selectively movable between an idle position and a card dispensing position. When money has been deposited in the bill acceptor on the machine, a credit register causes a drive motor to drive the card dispensing mechanism. Simultaneously with the driving of the card dispensing mechanism, the card dispensing mechanism is moved to its dispensing position so that a card will be dispensed from the stack. An adjustment means is provided for permitting the card dispenser mechanism to be adjusted to compensate for cards of various thicknesses.

DESCRIPTION OF THE PREFERRED EMBODIMENT

The card vending machine of this invention is referred to generally by the reference numeral 10 and includes a cabinet 12 having a front portion 14, back portion 16, opposite sides 18 and 20, top 22 and bottom 24. A closeable cover or door 26 is provided at the front portion of the cabinet and is hingedly mounted therein as illustrated in the drawing. Lock 28 is provided to maintain the door 26 in its locked condition.

Machine 10 includes a bill acceptor 30 of conventional design such as disclosed in U.S. Pat. No. 4,847,473. A viewing window 32 is also provided in door 26 which indicates the amount of credit which has been registered by the conventional credit register in the machine 10 to advise the player that he or she has been properly credited with the amount of money deposited in the bill acceptor 30. A pair of viewing windows 34 and 36 are also provided in the door 26 to permit the observation of the stacks 38 and 40. Start button 42 is also provided on door 26.

Figure 3:
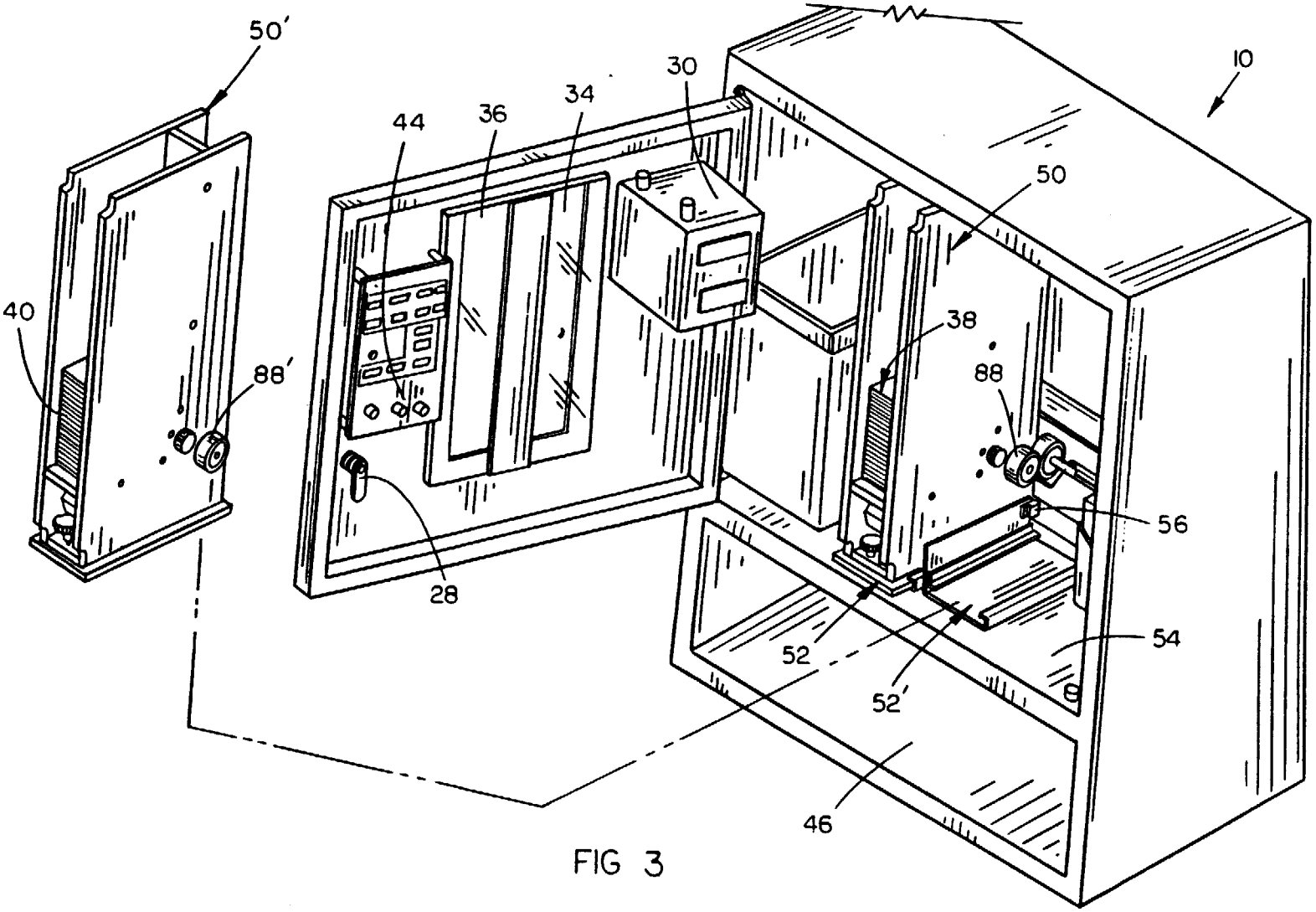
FIG. 3 is a front perspective view of the machine of this invention with the front portion thereof opened and one of the modules having been removed.
Figure 5:
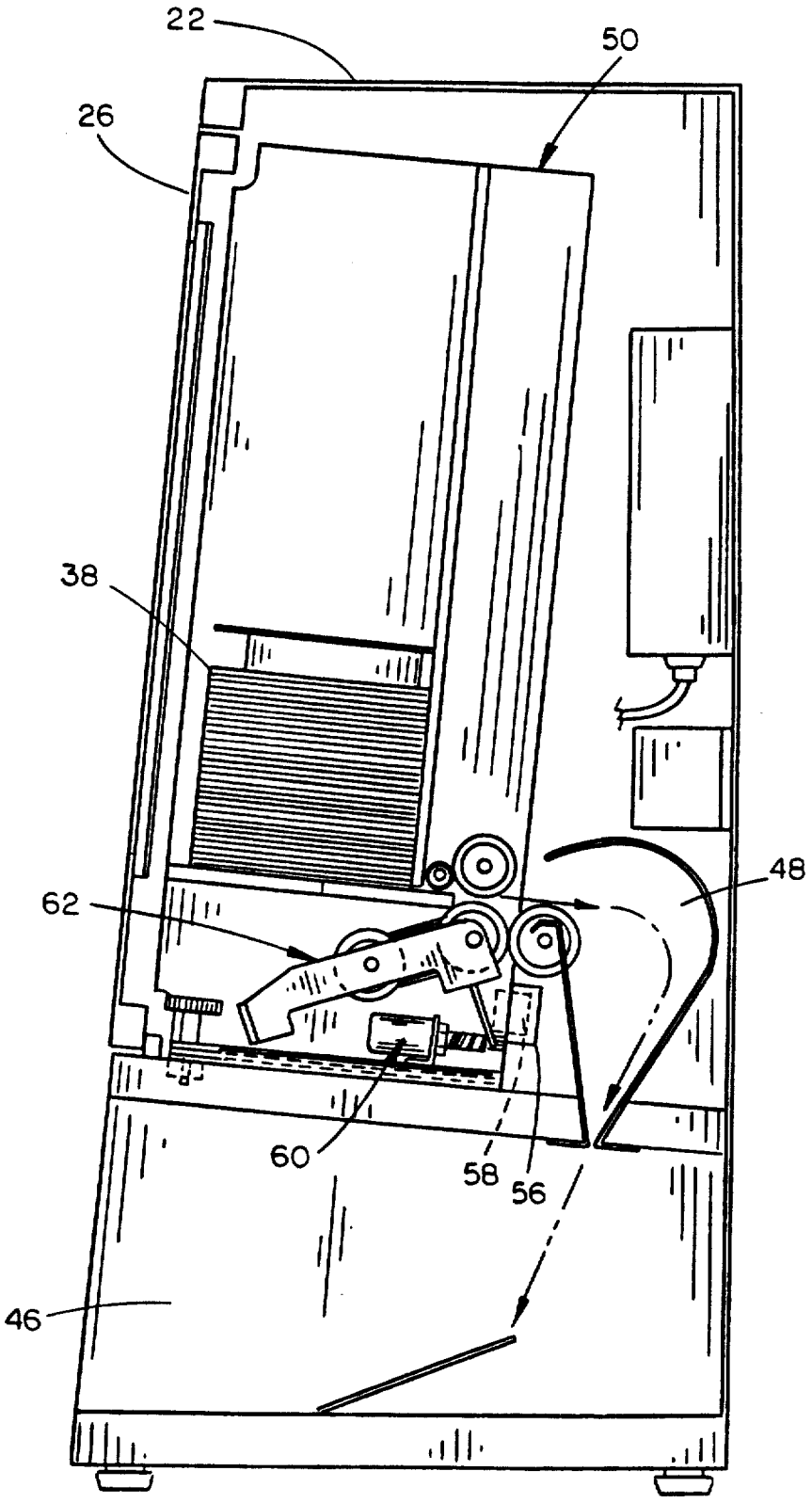
FIG. 5 is an interior side view of the machine as seen from the right of FIG. 1.

Referring to FIG. 3, the numeral 44 refers to the conventional credit register portion of the invention which displays the credit for the player through the window 32. Cabinet 12 is provided with a card access opening 46 at its lower front portion below door 26 as seen in FIG. 3. Card guide 48 is provided in the cabinet 12 for directing the dispensed cards into the access opening 46 as best illustrated in FIG. 5.

A plurality of card holding and dispensing modules 50 and 50' are removably positioned in trays 52 and 52, respectively which are mounted on shelf 54. Each of the trays 52 and 52, is provided with an electrical connector 56 which is adapted to receive the terminal 58 extending from the associated module to provide electrical current to the electric solenoid 60 of the card dispensing portion 62 of the module.

Figure 4:
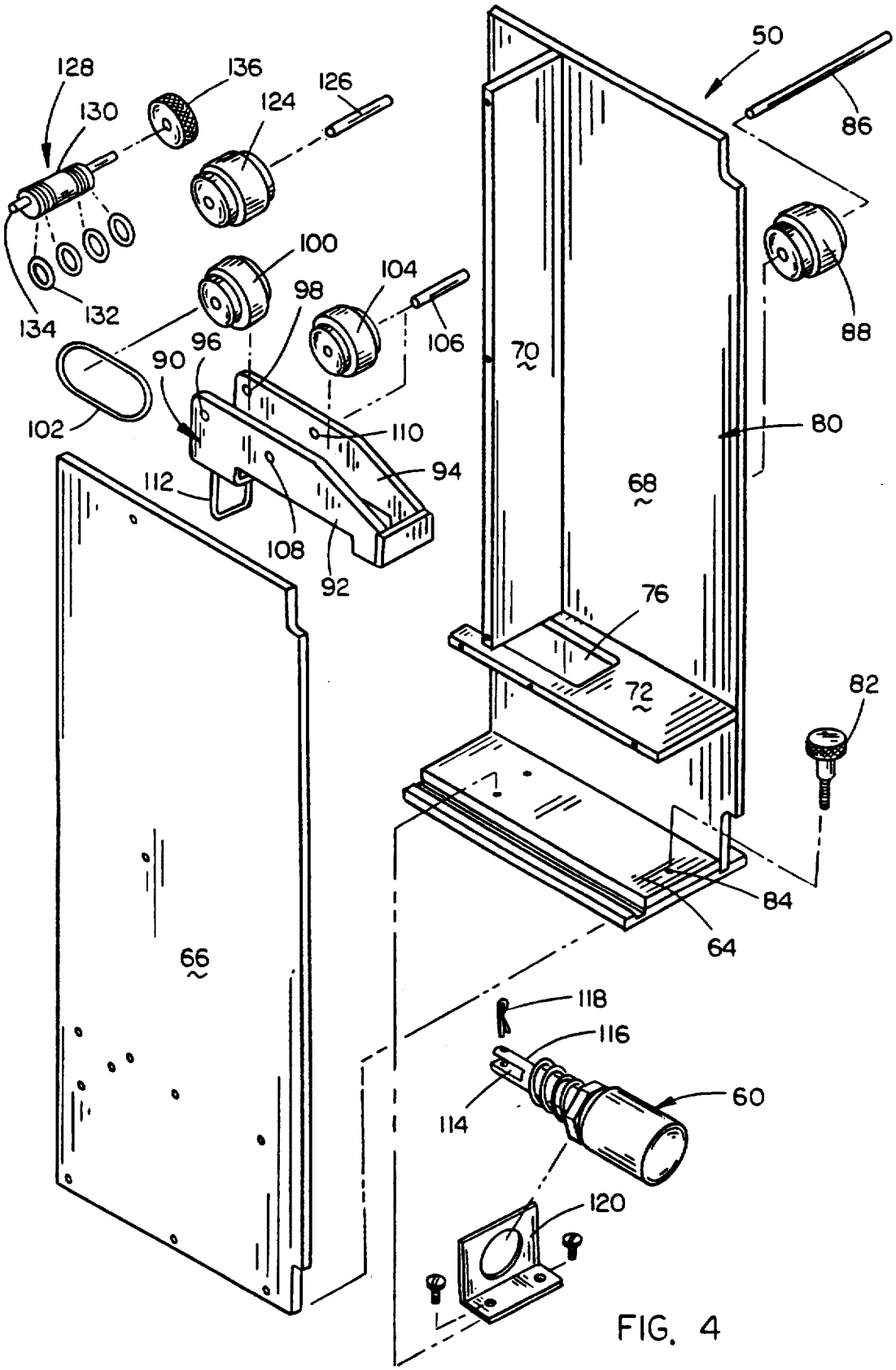
FIG. 4 is an exploded perspective view of one of the card holding and dispensing modules.
Figure 7:
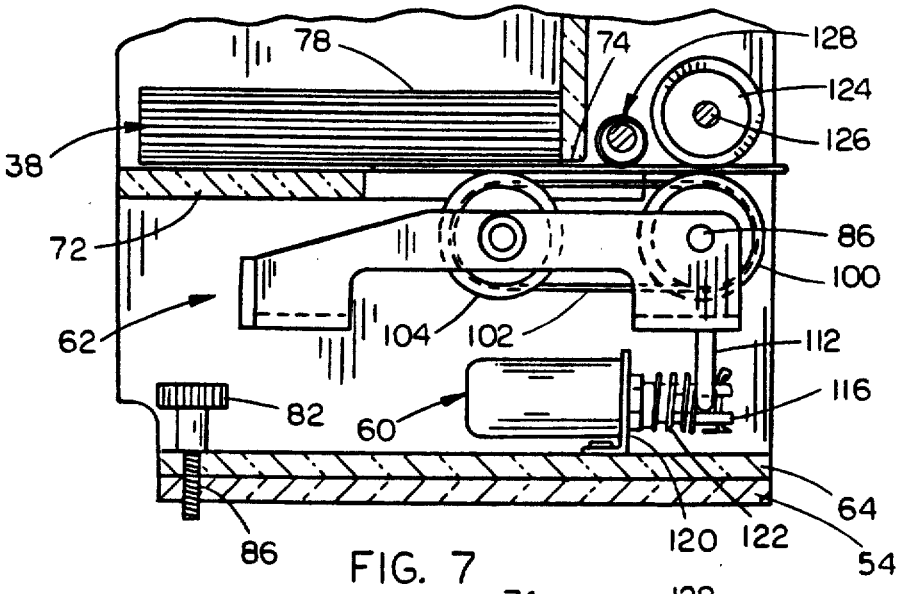
FIG. 7 is a sectional view illustrating a card being dispensed from one of the modules.

Referring to FIG. 4, the module 50 is illustrated in exploded perspective form. Module 50 includes a base 64 having sides 66 and 68 secured thereto and extending upwardly therefrom in a spaced apart condition. Partition 70 is secured to and extends between the walls 66 and 68 and has the card support plate 72 positioned therebelow. Card support plate 72 is positioned slightly below the lower end of partition 70 to create a card dispensing opening 74 therebetween (FIG. 7). Plate 72 has an opening 76 formed therein for a purpose to be described in more detail hereinafter. Individual cards 78 in the stack 38 rest upon the plate 72 as best seen in FIG. 7. Thus, the walls 66 and 68, partition 70 and plate 72 form a card holding portion 80 in the module 50. Thumb screw 82 is adapted to extend through opening 84 in bottom 64 for threadable connection to an internally threaded opening 86 in bottom 24 of cabinet 12 (FIG. 7) to positively maintain the module 50 in position within the cabinet 12.

Card dispensing mechanism 62 includes the solenoid 60 as a means for electrically operating the card dispensing mechanism 62 and drive wheels 100 and 104 with belt 102 providing a means for mechanically operating the card dispersing mechanism. The solenoid 60 as previously described with the electrical connection provide therefor being automatically achieved when terminal 58 is received in the connector 56 when the module 50 is positioned within the cabinet and the thumb screw 82 is in position. The card dispensing mechanism includes a shaft 86 which is rotatably mounted in the walls 66 and 68 and which extends therebetween. Drive wheel 88 is mounted on the exposed outer end of shaft 86 so that rotation of drive wheel 88 will cause rotation of shaft 86.

Bracket 90 is positioned between walls 66 and 68 and has a pair of spaced apart sides 92 and 94 as best seen in FIG. 4. Openings 96 and 98 are formed in sides 92 and 94 respectively adjacent the upper forward ends thereof which receive the shaft 86 extending therethrough. Drive wheel 100 is mounted on shaft 86 for rotation therewith between the sides 92 and 94 and has a drive belt 102 mounted thereon which extends rearwardly therefrom. The rearward end of drive belt 102 is connected to drive wheel 104 which is also positioned between sides 92 and 94 of bracket 90 and which is rotatably mounted on pin or shaft 106 which is mounted in the openings 108 and 110 formed in sides 92 and 94 respectively. Thus, rotation of shaft 86 by drive wheel 88 causes the rotation of drive wheels 100 and 104. Yoke 112 is secured to bracket 90 and extends downwardly therefrom. The lower end of yoke 112 is received in the notch 114 of the movable rod 116 of solenoid 60. Key 118 maintains the yoke 112 in the notch or slot 114. Solenoid 60 is mounted on bracket 120 which is secured to bottom 64.

Figure 8:
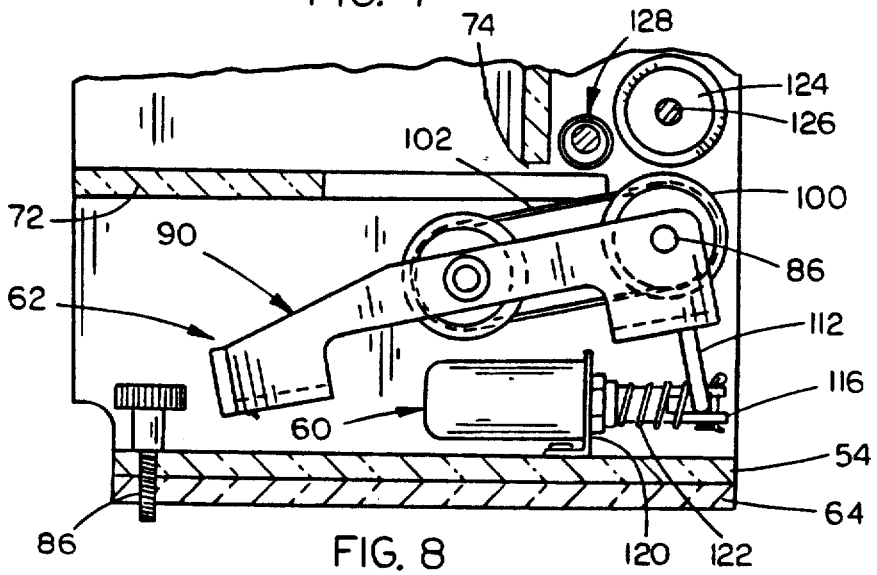
FIG. 8 is a view similar to FIG. 7 except that the card dispensing mechanism is in its idle position.

As seen in FIG. 8, when solenoid 60 is not activated, spring 122 causes the extension of the plunger or rod 116 from the solenoid 60 which causes the bracket 90 to be pivoted to the idle position illustrated in FIG. 8. When solenoid 60 is actuated, rod 116 is retracted into the body of the solenoid which causes the bracket 90 to pivot from the idle position of FIG. 8 to the card dispensing position of FIG. 7. When the bracket 62 is in the position illustrated in FIG. 7, drive wheel 104 extends upwardly through opening 76 in plate 72 so as to be in frictional engagement with the underside of the lowermost of the cards 78 in the stack 38. As see in FIGS. 4 and 7, a hold down roller or wheel 124 is rotatably mounted on shaft 126 which extends between the walls 66 and 68.

Figure 9:
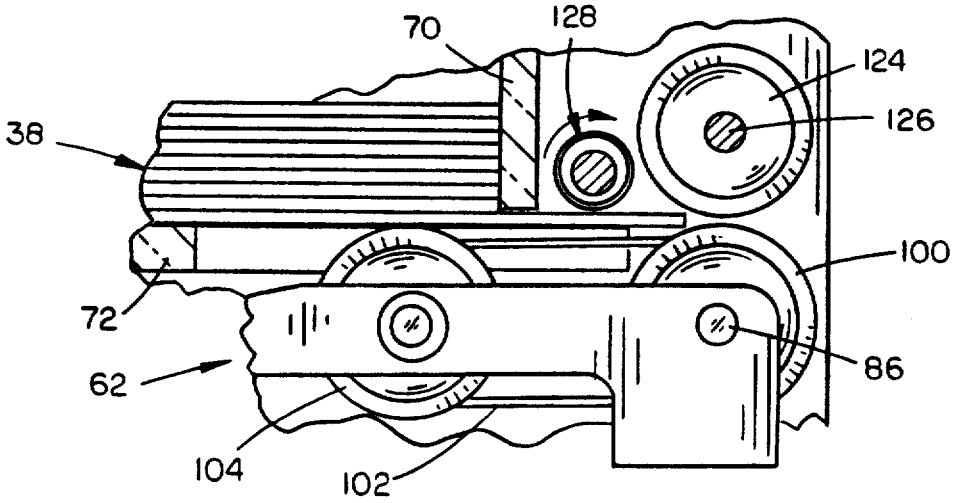
FIG. 9 is a sectional view similar to FIG. 8 except that it is enlarged.

A novel gauge cam 128 is rotatably mounted between the walls 66 and 68 just rearwardly of the dispensing opening 74 as best seen in FIGS. 7 and 9. Gauge cam 128 includes a cylindrical body portion 130 having a plurality of 0-rings 132 mounted thereon. Body 130 is mounted on shaft 134 in such a manner so that the shaft 134 is offset from the longitudinal axis of the body 130. One end of shaft 134 extends outwardly through side 68 and has a knob 136 mounted on the rearward end thereof. Thus, selective rotation of the knob 136 changes the vertical position of the lower end of the body 130 of the gauge cam 128 so that the dispensing mechanism may be adjusted to compensate for cards of various thicknesses. For example, if the cards 38 were very thin, it would be possible for more than one card to pass through the dispensing opening 74 if the gauge cam 128 were not present. By rotating the shaft 134 by means of the knob 136, the effective height of the dispensing opening 74 is reduced. In other words, if two cards were able to pass through the dispensing opening 74, only the lowermost card would be able to pass beneath gauge cam 128 due to its previous adjustment.

Figure 6:
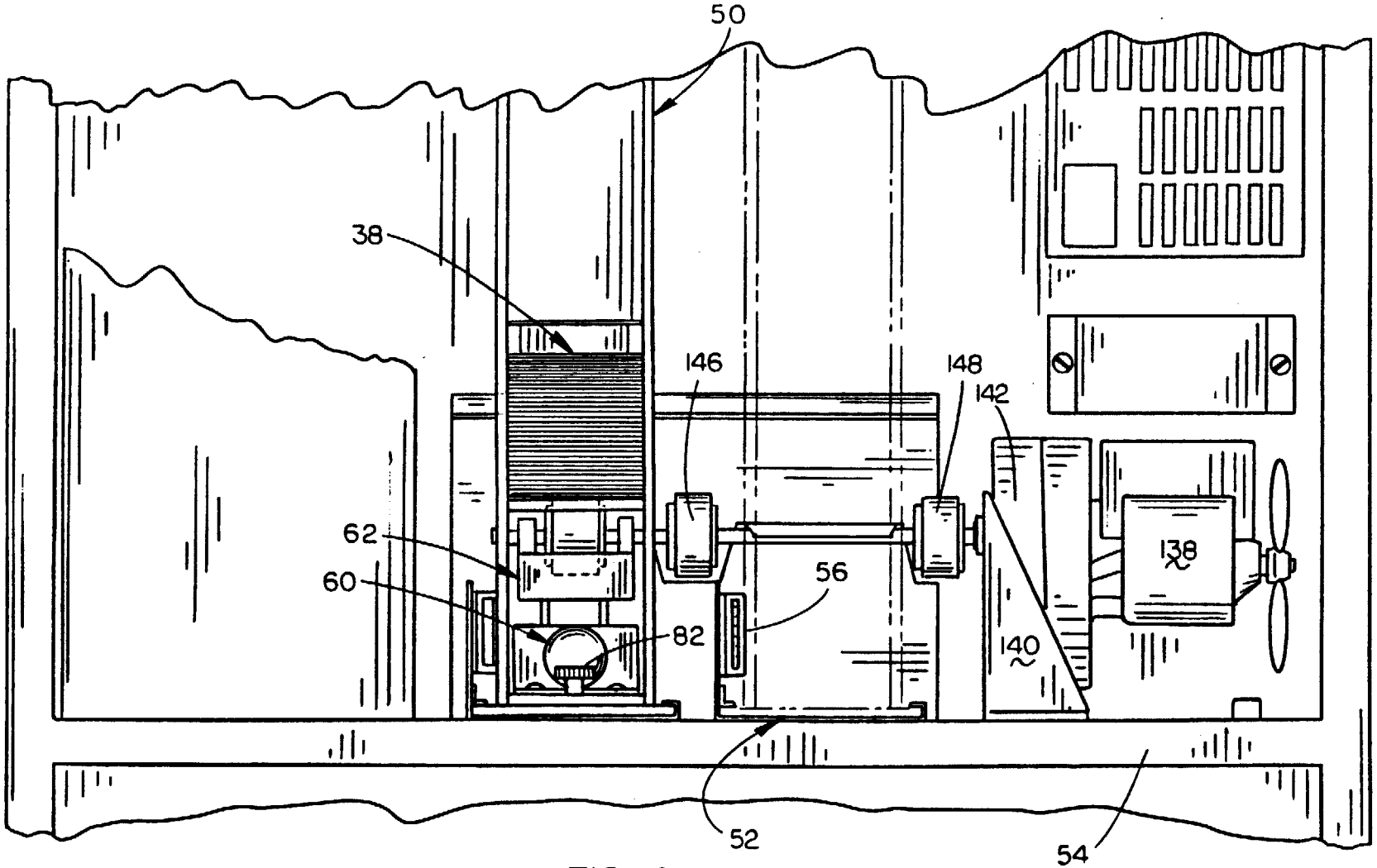
FIG. 6 is a partial front elevational view of the machine with the cover or door open and with one of the modules removed.

Referring now to FIG. 6, it can be seen that an electric motor 138 is mounted on bracket 140 which is secured to the upper surface of shelf 54. Gear box 142 is operatively connected to the motor 138 and has drive shaft 144 extending therefrom. A pair of spaced apart drive rollers 146 and 148 are mounted on the drive shaft 144 for rotation therewith. When the modules 50 and 50' are secured in their trays 52 and 52' respectively, the drive wheels 88 and 88' are in driven engagement with the drive wheels 146 and 148 respectively.

The electrical circuitry for the invention has not been shown or described for purposes of conciseness. Assuming that a bill has been placed in the bill acceptor 30, the credit register 44 will indicate to the player through the window 32 that the player is entitled to credit. The player then presses button 42. Immediately upon the button 42 being depressed, motor 138 is actuated to cause the rotation of the drive wheels 146 and 148 which causes the rotation of the drive wheels 88 and 88' respectively. Inasmuch as the operation of the card dispenser is identical in each module, only the operation of the module 50 will be described. It should be understood that any number of modules may be employed. It should also be understood that the various modules may have cards of different denominations therein.

Simultaneously with the actuation of the motor 138, solenoid 60 is actuated to cause the bracket 90 to pivot from the position of FIG. 8 to the position of FIG. 7 so that the rotating drive wheel 104 will frictionally engage the underside of the lowermost card in the stack 38 to move the same from the stack towards the right as viewed in FIG. 7. The forward end of the lowermost card 78 passes through opening 74 and beneath the gauge cam 128, which has been previously adjusted, so that only a single card will pass therebeneath, and will be received between the idler wheel 124 and the drive wheel 100 so that the card will be completely pulled from the stack and will be delivered to the guide 48 as illustrated by the arrows in Figure 5 so that the card will be deposited in the card access opening 46. After the prescribed dispensing time has elapsed, the solenoid 60 is de-energized which causes the bracket 62 to pivot from the position of FIG. 7 to the position of FIG. 8 to prevent the dispensing of additional cards. If more than one card is to be dispensed, the solenoids on the two modules will be alternately actuated so that cards will be alternately taken from each of the stacks to prevent one stack in one module from being depleted while the stack in the other module is still substantially full.

Thus it can be seen that a novel card vending machine has been described which includes a plurality of card holding and dispensing modules which may be individually replaced should one of the same require repair. Thus, a maintenance person may simply replace a malfunctioning module with a functioning module and then take the malfunctioning module back to the repair shop for repair without requiring that the vending machine be placed out of service for any length of time. It can also be seen that the unique gauge cam assembly described herein enables the card dispensing mechanism to be adjusted to compensate for cards having various thicknesses.

It can therefore be seen that the card vending machine of this invention accomplishes at least all of its stated objectives.

We claim:

1. A card vending machine, comprising, a cabinet means having a front portion, a rear portion, opposite sides, an upper end and a lower end, a plurality of card holding and dispensing modules in said cabinet means, each of said card holding and dispensing modules being individually removably positioned in said cabinet means, each of said modules including a card holding portion for holding a plurality of cards therein in a stacked condition, each of said modules including a card dispensing mechanism for dispensing the lowermost card in the stack in the associated card holding portion, said card dispensing mechanism in each of said modules being selectively movable between an idle position and a card dispensing position, a bill acceptor sensing means in said cabinet means for accepting and sensing the deposit of one or more bills of various denominations, a credit register means in said cabinet means operatively connected to said bill acceptor sensing means for electronically registering a credit corresponding to the amount deposited in said bill acceptor sensing means, an electrically operated drive motor positioned in said cabinet means and having a drive shaft extending therefrom, said drive shaft being in operative engagement with the card dispensing mechanism of each of said modules for driving the same, said cabinet means having a card access opening formed therein, said card access opening being in operative communication with said card dispensing mechanisms so that dispensed cards will be delivered to said card access opening to enable a player to collect the same, actuator means for moving the said card dispensing mechanism in each of said modules to its card dispensing position, and control means operatively interconnecting said credit register means, said drive motor and said actuator means whereby said actuator means will move said card dispensing mechanism to its card dispensing position during the time said drive motor is driving said card dispensing mechanism so that cards will be dispensed from the associated card holder portion for delivery to said card discharge opening.

2. The card vending machine of claim 1 wherein the card dispensing mechanism in each of said modules is electrically operated and wherein said cabinet includes an electrical connector for each of said modules, each of said modules including an electrical terminal which is operatively electrically connected to the associated card dispensing mechanism, said electrical terminal of each of said modules being automatically connected to one of said electrical connectors when the said module is positioned in said cabinet means.

3. The card vending machine of claim 1 wherein said card dispensing mechanism of each of said modules includes adjustment means to enable the card dispensing mechanism to accommodate cards having various thicknesses.

4. The card vending machine of claim 1 wherein said card holding portion includes a pair of upstanding side walls which are spaced apart sufficiently to receive the cards therebetween in a stacked condition, an upstanding back wall extending between said side walls, a bottom wall extending between said side walls below said back wall, said bottom wall being spaced below the lower end of said back wall to define a card dispensing slot, a gauge cam positioned rearwardly of said back wall and said card dispensing slot, said gauge cam being positioned above said bottom wall to define a card receiving space therebetween which is positioned closely adjacent to said card dispensing slot and which is adapted to receive a card therein as a card is being dispensed through said card dispensing slot, said gauge cam being selectively adjustable with respect to said card receiving space to permit the dispensing of cards having varying thicknesses.

5. The card vending machine of claim 4 wherein said gauge cam comprises an elongated horizontally disposed cylindrical body portion having shafts extending from the opposite ends thereof, said shafts being aligned with each other but being offset from the center axis of said body portion so that selective rotation of one of said shafts will lower or raise said body portion relative to said slot.

6. The card vending machine of claim 1 wherein said card holding portion includes a pair of upstanding side walls which are spaced apart sufficiently to receive the cards therebetween in a stacked condition, an upstanding back wall extending between said side walls, a bottom wall extending between said side walls below said back wall, said bottom wall being spaced below the lower end of said back wall to define a card dispensing slot, said bottom wall having an opening formed therein, said card dispensing mechanism comprising a support bracket means pivotally mounted below said bottom wall and which is movable between an idle position and a dispensing position, said bracket having a drive wheel mounted thereon which is moved upwardly into said opening in said bottom wall, for engagement with the lowermost card in the associated card holder portion, when said bracket is moved to its said dispensing position, and means for selectively moving said bracket to its : said dispensing position.

7. The card vending machine of claim 6 wherein said drive wheel on each of said modules is automatically operatively connected to said drive shaft of said drive motor when said module is positioned in said cabinet means.

8. A card vending machine, comprising, a cabinet means having a front portion, a rear portion, opposite sides, an upper end and a lower end, a plurality of card holding and dispensing modules in said cabinet means, each of said card holding and dispensing modules being individually removably positioned in said cabinet means, each of said modules including a card holding portion for holding a plurality of cards therein in a stacked condition, each of said modules including a card dispensing mechanism for dispensing the lowermost card in the stack in the associated card holding portion, and each of said card dispensing mechanisms including an electrically operated means and a mechanically operated means, each of said modules including means for automatically connecting said electrically operated means and said mechanically operated means to compatible components in said cabinet means, said card dispensing mechanism being in operative engagement with the lowermost card in said stack when in its card dispensing position whereby said card dispensing mechanism may dispense a card from said stack, said card dispensing mechanism being free from engagement with the lowermost card in said stack when in its idle position.

* * * * *